US007857152B2

(12) United States Patent
Smith

(10) Patent No.: US 7,857,152 B2
(45) Date of Patent: Dec. 28, 2010

(54) FLUE SPACER

(75) Inventor: Gary Thomas Smith, Suffolk, VA (US)

(73) Assignee: Design Assistance Construction Systems, Inc., Portsmouth, VA (US)

( * ) Notice: Subject to any disclaimer, the term of this patent is extended or adjusted under 35 U.S.C. 154(b) by 848 days.

(21) Appl. No.: 11/691,366

(22) Filed: Mar. 26, 2007

(65) Prior Publication Data

US 2008/0237161 A1 Oct. 2, 2008

(51) Int. Cl.
*A47B 57/00* (2006.01)

(52) U.S. Cl. ..... 211/187; 211/181.1; 211/206

(58) Field of Classification Search ..... 211/187, 211/181.1, 123, 105.5, 105.6, 204, 206, 186, 211/106
See application file for complete search history.

(56) References Cited

U.S. PATENT DOCUMENTS 1,687,383 A * 10/1928 O'Neil ..... 108/28
2,598,957 A * 6/1952 Wolfe ..... 312/100
2,617,571 A 11/1952 Hart
2,655,268 A * 10/1953 Whaley ..... 211/88.04
3,378,219 A * 4/1968 Biesecker ..... 248/231.21
3,836,174 A 9/1974 Holman, Jr.
4,004,819 A * 1/1977 Brongo ..... 280/79.3
4,291,928 A * 9/1981 Kiyosawa ..... 312/140
4,488,651 A * 12/1984 Bishop ..... 211/105.6
6,073,786 A * 6/2000 McCorkle, Jr. ..... 211/187
6,578,720 B1 6/2003 Wang
6,986,431 B2 * 1/2006 Koester et al. ..... 211/187
7,614,511 B2 * 11/2009 Konstant ..... 211/189
2007/0095773 A1 5/2007 Schwerman

* cited by examiner

*Primary Examiner*—Korie Chan
(74) *Attorney, Agent, or Firm*—Hunton & Williams

(57) ABSTRACT

A flue spacer for providing a flue space in a storage rack having a transversely extending spacer surface and first and second legs. The first and second legs extend from the spacer surface and are adapted to attach the spacer surface to at least two uprights of the storage rack so that the spacer surface is offset from the uprights to form a vertical flue space within the storage rack. At least one of the legs may be adapted to attach to a lateral surface of an upright. The flue spacer also may be adapted to extend across multiple storage racks. A shelving system using the flue spacer is also provided.

9 Claims, 11 Drawing Sheets

FLUE SPACER

FIELD OF THE INVENTION

The present invention relates generally to spacers that create flue space. More specifically, the present invention relates to spacers that attach to uprights of storage racks to create flue space.

BACKGROUND OF THE INVENTION

Storage racks are widely used in industrial and commercial settings. In these settings, it is desirable to maximize the space offered by these racks. This is accomplished by placing pallets or boxes close to each other, oftentimes such that they occupy the entire shelf space, leaving little or no space between the pallets or boxes. This practice can make the stored boxes or pallets especially susceptible to fire damage.

In a typical setting where storage racks are used, such as a warehouse, smoke detectors and overhead sprinkler systems are commonly employed as fire safety and containment systems. Several factors can affect the effectiveness of these systems. For example, to maximize the effectiveness of the sprinkler system in containing a fire, the fire needs to reach the sprinkler heads as quickly as possible in order to extinguish the fire before it builds up too much heat and intensity. Similarly, the benefits of smoke detectors can best be utilized if smoke triggers the detectors in the early stages of a fire. Additionally, water from the overhead sprinkler system needs to freely flow through the shelves to contain a fire that has broken out at any shelving level and to prevent it from spreading to other storage racks. When stored goods are closely and tightly spaced on a shelf, the effectiveness of the fire safety and containment systems are reduced because smoke cannot rise, fire cannot dissipate, and water cannot freely flow to the fire. This is particularly problematic in storage facilities that store large numbers of boxes because boxes can be packed together to form a relatively tight seal against rising smoke and descending water.

Efforts have been made to address this problem. In certain storage environments, fire codes require the surface area of each shelf to have a certain amount of open area—generally fifty percent of the surface area. These open areas serve two primary purposes. First, the open areas allow a fire that has broken out on a lower rack level to travel upwards and to release heat in the process. Thus, the fire progresses upwards towards overhead sprinklers to activate the sprinklers, rather than laterally through the rack. Second, the open areas of each shelf allow water from the overhead sprinkler system to flow downward to the lower rack levels once the fire has been detected. One system that meets these fire code regulations is described in U.S. Pat. No. 6,401,944 to Kircher et al. entitled "Storage Rack Shelving," and U.S. Pat No. 7,156,243 to Henning et al. entitled "Perforated Decking," which are incorporated herein by reference. Kircher et al. discloses a corrugated deck for use as shelving with a plurality of apertures forming open areas comprising fifty percent of the surface area of each deck.

While the fifty percent open area regulation provides a useful mechanism to address fire safety and containment, some fire codes, such as foreign fire codes, may not require shelves with a fifty percent open area in all storage environments. In some storage environments, a lower percentage of open area may be allowed, while in others, there may be no requirement for open areas in the shelves.

Another system that has been employed to address the fire safety issue in storage racks is the use of vertical flue spaces.

Flue spaces are gaps or openings left in the storage rack structure that form a vertical passage that allows fires to spread vertically to the sprinklers and water to flow down to lower rack levels. The sizes and locations of such flue spaces are typically dictated by local or national fire codes, fire protection standards and/or insurance requirements. there are two common types of flue space: "transverse" flue spaces, which are usually located at every rack upright and are perpendicular to the rack rows (i.e., they extend from the front of the shelving space to the back of the shelving space); and "longitudinal" flue spaces, which run parallel to the rack rows, and may be located between back-to-back rows or may even be formed by aisles between the racks. Typical flue spaces are required to be six inches wide, and fire inspectors and codes often allow the space between the rack uprights to form a portion of this width.

While flue spaces are commonly required, they are typically provided by simply stacking the boxes or other stored goods towards one upright, leaving the required flue space at the other end. This is shown in FIGS. 1A-1C, which illustrate top and front views of a typical set of storage racks, and an isometric view of a similar storage rack. In FIGS 1A-1B, there are two racks 102, which are positioned back-to-back with an aisle 104 on either side. Each rack 102 includes a number of vertical uprights 106 that support horizontal crossbars 108. As shown in FIG. 1C, typical uprights have front faces 118 having "teardrop" holes 120, and lateral faces 122 that have square holes 124. Shelves 110 are mounted on the crossbars 108 between each set of uprights 106 to form separate storage spaces 111 on the racks 102. Boxes 112 or other stored goods are stored within the storage spaces 111. As shown, in common practice, a transverse flue space 114 is formed within each storage space 111 by simply stacking the boxes 112 towards one end of the storage space 111. This leaves a transverse flue space having width "w," which, as shown, is partially formed by the gap between the uprights 106. To promote proper box stacking, the shelves 110 may extend only up to the edge of the desired flue space 114, making it more difficult to obstruct the flue space 114. In fact, when rack manufacturers are informed of the size of the articles being stored, they often size the racks to fit a specific number of articles, but leave a sufficiently wide transverse flue space.

In addition to transverse flue spaces, the storage racks 102 may have a longitudinal flue space 116 formed between them. In some cases, wires, straps or meshes have been stretched between adjacent rear uprights 106 to prevent boxes or other goods from extending into this longitudinal flue space. Such attempts to maintain the longitudinal flue space have been marginally successful because such devices tend to bend or buckle when boxes are pressed against them.

While the foregoing flue space system is simple and inexpensive, it suffers from a number of problems. Primarily, it is not uncommon for boxes to be positioned to partially or fully obstruct the flue space. Furthermore, even when the boxes are properly stacked, they can deform over time and ultimately lean into, and possibly obstruct, the flue space.

Some efforts have been made to address these problems. One such effort is described in U.S. Pat. No. 5,160,294 to Petter entitled "Spacer Rack for Smoke Detection," which is incorporated herein by reference. Petter discloses an open wire mesh column that extends from the front to the back of a pallet storage rack to create a vertical passageway through which smoke can travel. However, the Petter system suffers from a number of shortcomings. For example, the Petter system is large and bulky. The size and complexity of the system makes it difficult to implement. In addition, the system must be set up on an empty storage rack. Thus, the Petter system would either have to be set up prior to using the storage rack or after emptying the items already on the storage rack in order to retrofit those racks. Additionally, the Petter system requires the wire mesh columns to penetrate through each shelving layer to form the passageway. Thus, the system would require extensive modification of the storage rack shelves where storage racks with continuous shelves are used.

It is believed that another effort to address the problem with conventional flue spaces provided relatively complex welded crossbars that were mounted to the front face of each front upright (i.e., the surface facing the aisle 104), and the rear face of each rear upright (i.e., the surface facing the longitudinal flue space 116). In addition to being relatively difficult to manufacture, and thus expensive, it is understood that these crossbars were difficult to install on a common rack system, particularly where the rack was already loaded with boxes or other goods.

Therefore a need still exists for an economical and functional flue spacer system that will address the fire safety issue in storage racks and allow retrofitting to filled storage racks.

SUMMARY OF THE INVENTION

In one aspect, a flue spacer for providing a flue space in a storage rack is provided. The exemplary flue spacer has a transversely extending spacer surface and first and second legs. The first and second legs extend from the spacer surface and are adapted to attach the spacer surface to at least two uprights of the storage rack so that the spacer surface is offset from the uprights to form a vertical flue space within the storage rack. At least one of the legs is adapted to attach to a lateral surface of an upright.

In another aspect, a shelving system is provided. The exemplary shelving system has uprights, shelves, and a flue spacer. The shelves are suspended on the uprights to form a storage rack. The flue spacer has a transversely extending spacer surface and first and second legs. The first and second legs extend from the spacer surface and are adapted to attach the spacer surface to at least two uprights of the storage rack so that the spacer surface is offset from the uprights to form a vertical flue space within the storage rack. At least one of the legs is adapted to attach to a lateral surface of an upright.

In still another aspect, a flue spacer for providing a flue space in a storage rack is provided. The exemplary flue spacer has a transversely extending spacer surface and first and second legs. The first and second legs extend from the spacer surface and are adapted to attach the spacer surface to at least two uprights of the storage rack so that the spacer surface is offset from the uprights to form a vertical flue space within the storage rack. The first and second legs have holes for a fastener to mount the first and second legs to uprights At least one of the legs is adapted to attach to a lateral surface of an upright.

In still another aspect, a flue spacer for providing a flue space in adjacent storage racks is provided. The exemplary flue spacer has a transversely extending spacer surface and first and second legs. The first and second legs extend from the spacer surface and are adapted to attach the spacer surface to a first upright of a first storage rack and a second upright of a second storage rack such that the spacer surface is offset from the uprights to form a vertical flue space within the first and second storage racks.

The foregoing aspects are exemplary only, and not intended to limit the claimed invention. Other variations on the foregoing will be apparent to one of ordinary skill in the art after studying the present disclosure and practicing the inventions described herein.

BRIEF DESCRIPTION OF THE DRAWINGS

Embodiments of the invention are described in the following exemplary drawing figures.

DETAILED DESCRIPTION OF THE PREFERRED EMBODIMENTS

The present invention provides a system for providing flue spaces in storage racks. Because a typical storage facility can contain hundreds of storage racks, one preferred embodiment of the invention is simple to install, inexpensive to manufacture, and does not consume a large portion of the valuable storage space. In addition, the preferred embodiment preferably can be easily retrofitted into existing storage racks that already are filled with items. While it is most preferred for embodiments of the present invention to satisfy one or more of these objectives, it will be understood that this is not strictly necessary of all embodiments of the invention, and the statement of these objectives is not intended to limit the claimed invention in any way.

Figure 1A:
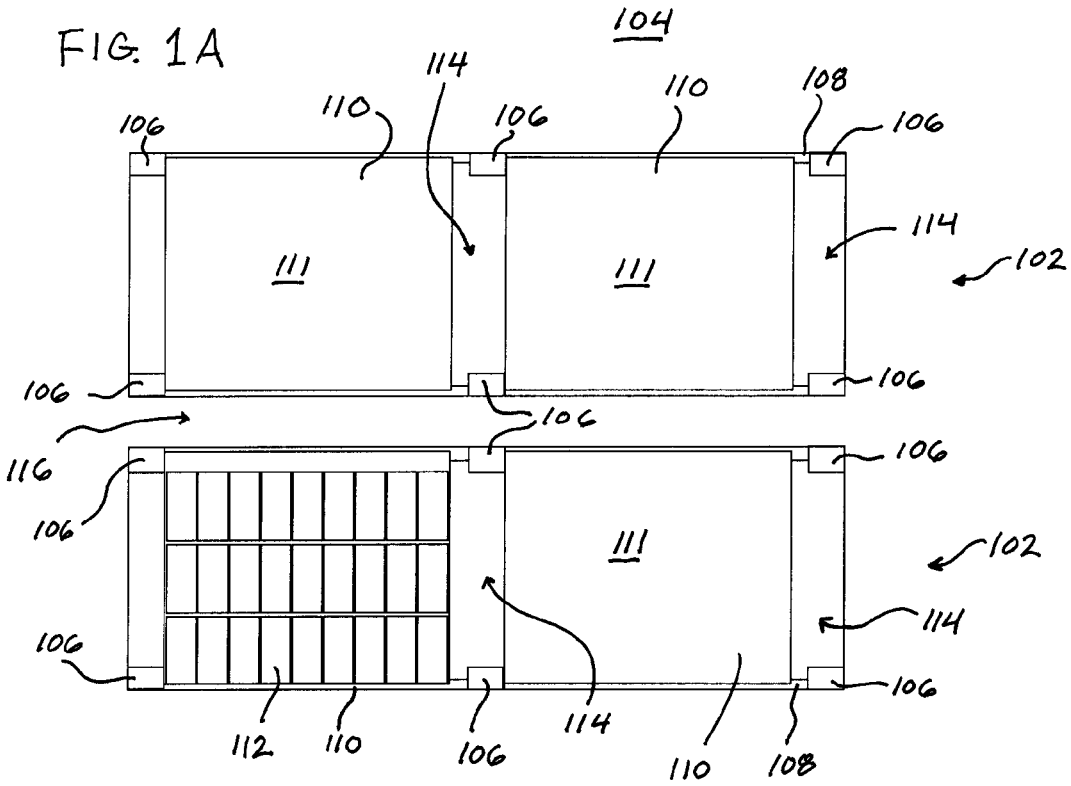
FIGS. 1A-1C illustrate a typical storage rack system.
Figure 1B:
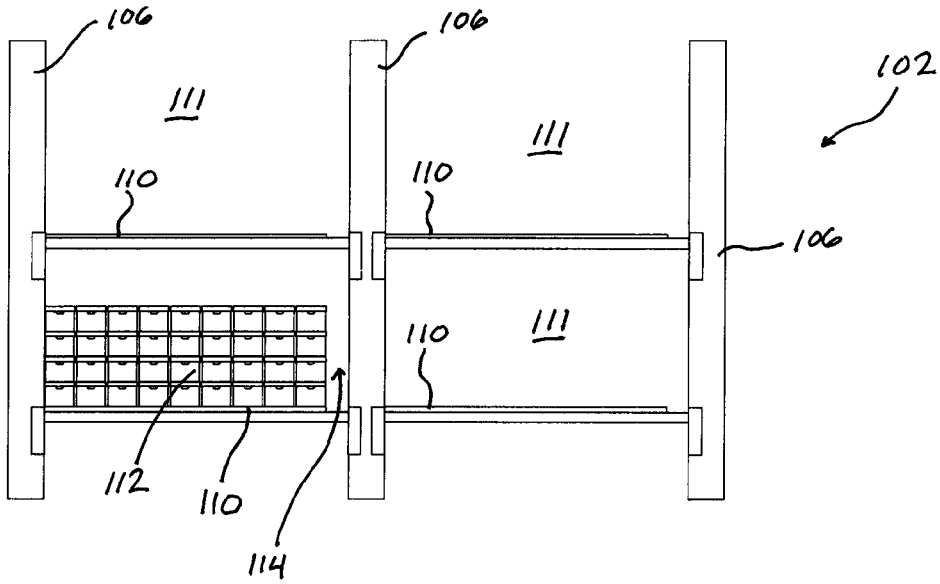
Figure 1C:
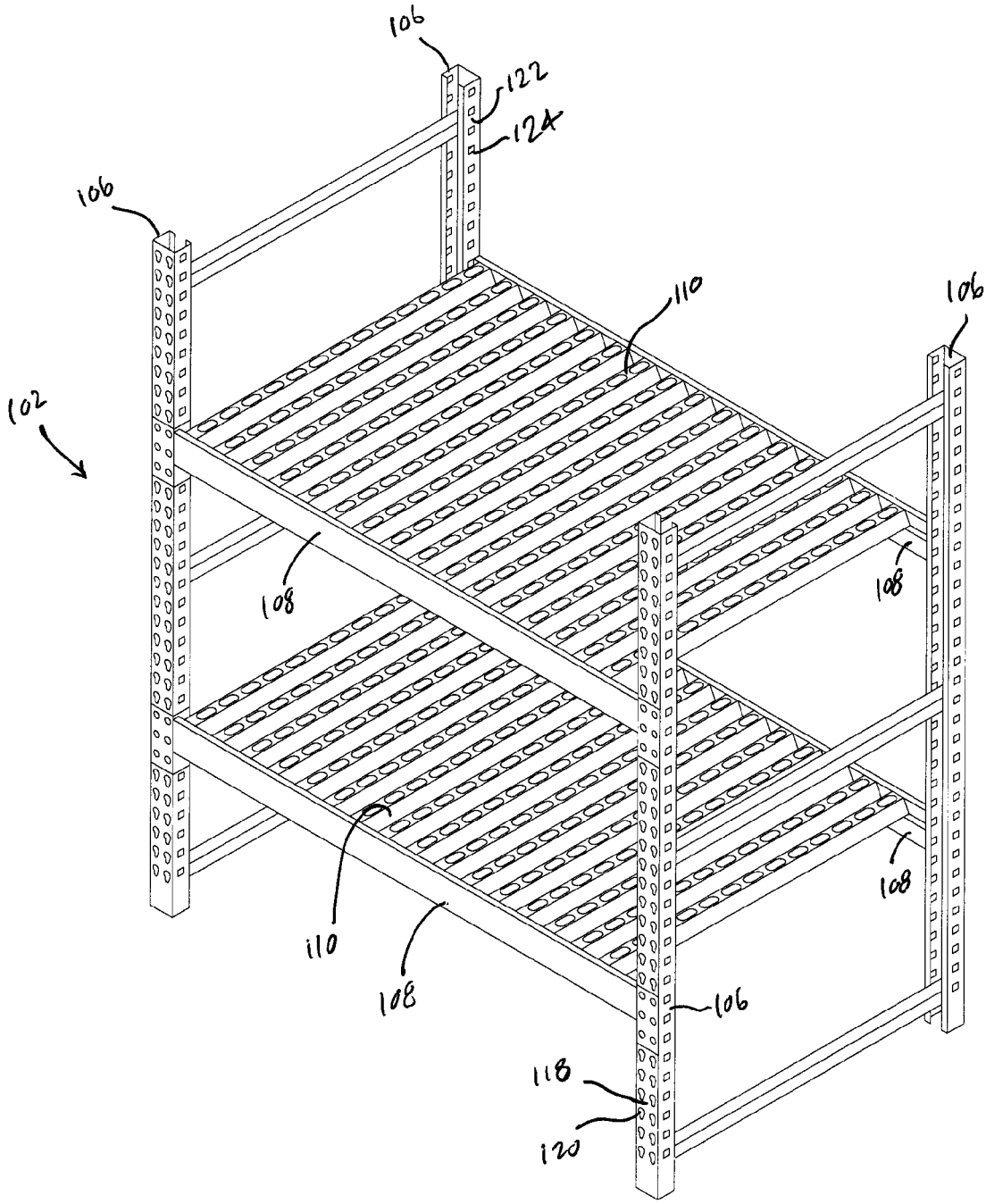

FIGS. 1A-1C illustrate a typical storage rack commonly used in industrial and commercial settings. The storage racks are made up of vertical uprights 106 and shelves 110 that form storage spaces 111 in which items, such as boxes, can be stacked. The shelves can be solid shelves or shelves with apertures that form open areas, such as those described in U.S. Pat. Nos. 6,401,944 and 7,156,243. Additionally, the shelves 110 of each storage rack level can be made of one continuous shelf or can be made of multiple shelf pieces, as shown. Oftentimes, these shelves are filled to capacity so that the items being stored are so tightly packed that there is little or no space within the storage rack and the surface area of the shelf is almost entirely covered. Even where the user intends to leave a vertical flue space, such spaces can be difficult to create or maintain in practice, can become blocked. This lack of flue spaces can diminish the effectiveness of fire detection and containment systems if a fire starts in the storage rack.

The flue spacer of the present invention addresses this problem by providing and maintaining a flue space within the storage rack.

Figure 2A:
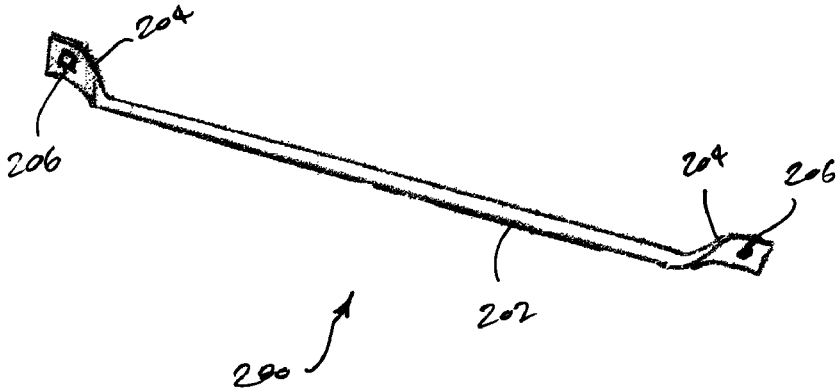
FIGS. 2A-2C illustrate one embodiment of a flue spacer of the present invention comprising a generally straight surface.
Figure 2B:
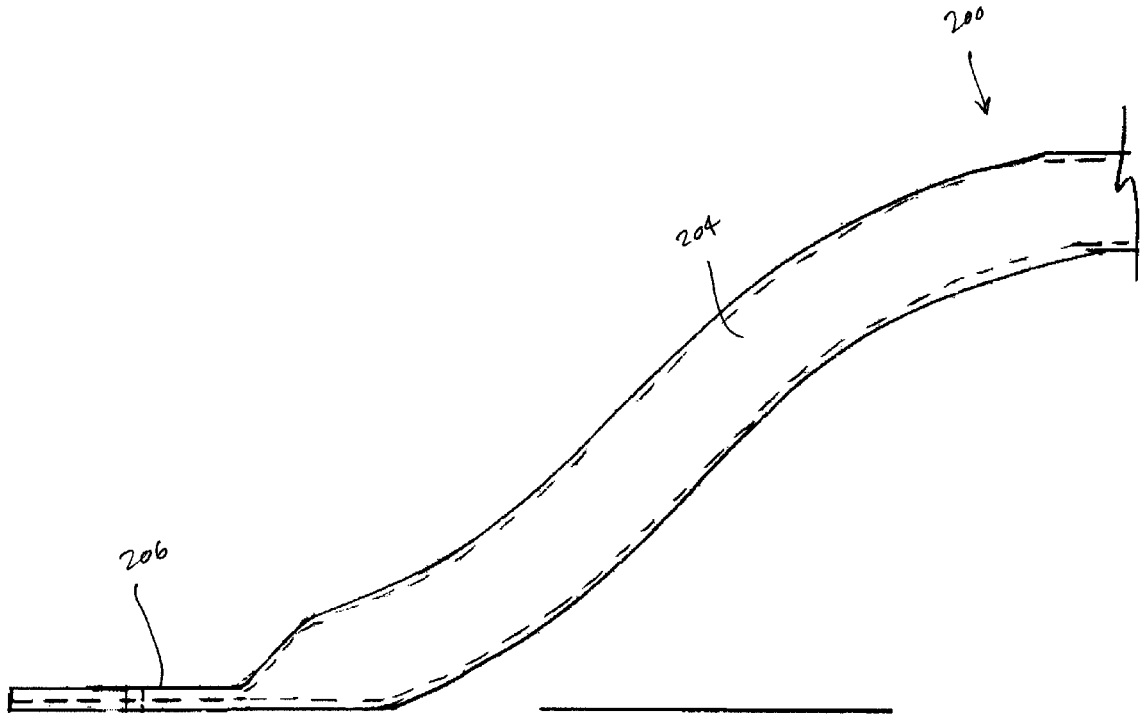
Figure 2C:
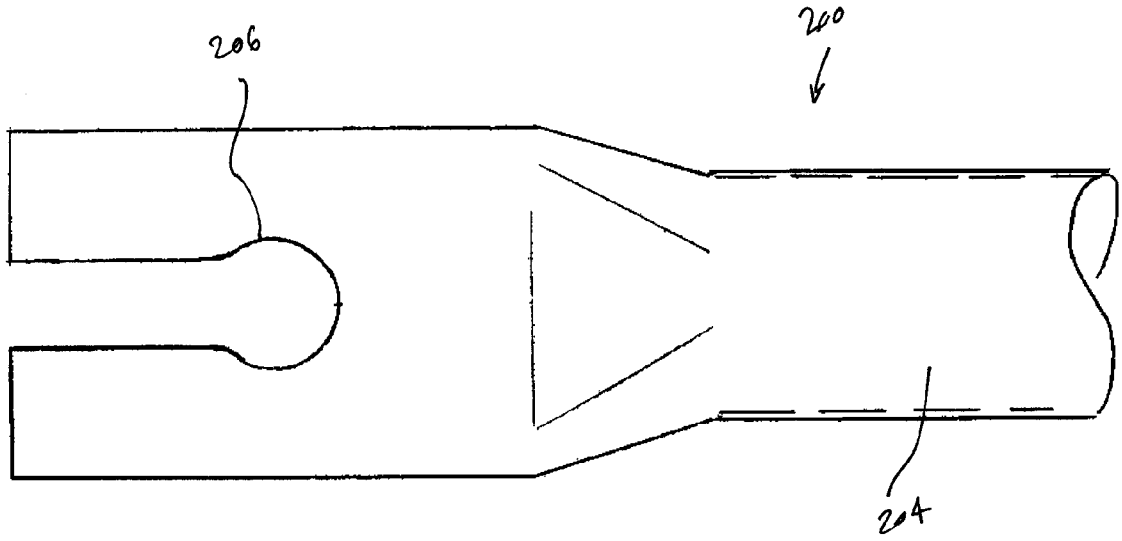

Referring now to FIGS. 2A-2C, the details of one embodiment of a flue spacer 200 of the present invention are described in greater detail. The spacer 200 has a spacer surface 202 and two legs 204 that extend from the spacer surface 202. The spacer surface 202 has a generally linear shape with a circular profile, but other shapes may be used. Also, this embodiment is intended to extend transversely from the front of the storage rack 102 to the back, thus forming a transverse flue space. However, this design may be modified such that the spacer 200 is located at the back of the rack to form a longitudinal flue space. Each of the legs 204 has an attachment element 206 for attaching the spacer surface 202 to an upright 106 of the storage rack. In this embodiment, the attachment elements are slotted holes for use with respective fasteners. Any suitable fastener may be used. Examples of fasteners generally known in the art include, but are not limited to, screws and bolts. A preferred fastener is a self-tapping screw, such as those commonly known as "Tek Screws."

As noted above, the flue spacer 200 may be made with any suitable shape. To this end, the spacer 200 may be formed, cast, or assembled in any known manner. One preferred way to form the spacer of FIG. 2 is to begin with a tubular rod, such as 0.75 inch diameter galvanized tubular steel conduit. The rod is flattened at each end, and holes and/or slots are formed into the legs to form the attachment elements 206. The legs 204 are formed by bending the tubular rod into the desired shape. In a preferred embodiment, the legs 204 are sized to offset the spacer surface 202 by about 3 inches or more from the uprights 106 to which the legs 204 attach. Also in a preferred embodiment, the flue spacer 200 has a length of about 49 to 50 inches from end to end.

Figure 3B:
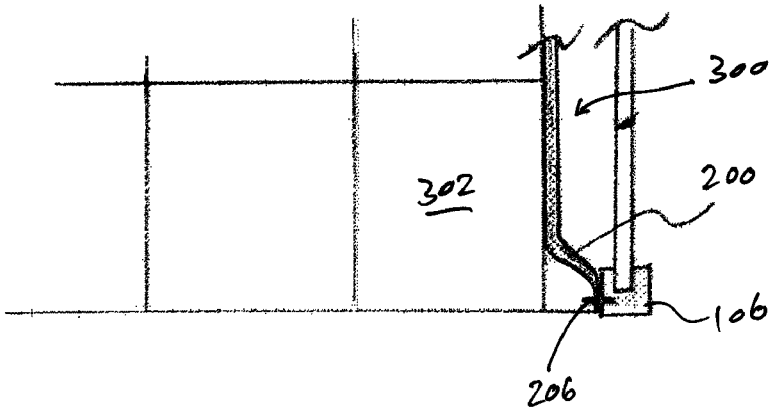
FIGS. 3A and 3B illustrate the embodiment of a flue spacer as shown in FIG. 2 attached to the uprights of a storage rack.
Figure 3A:
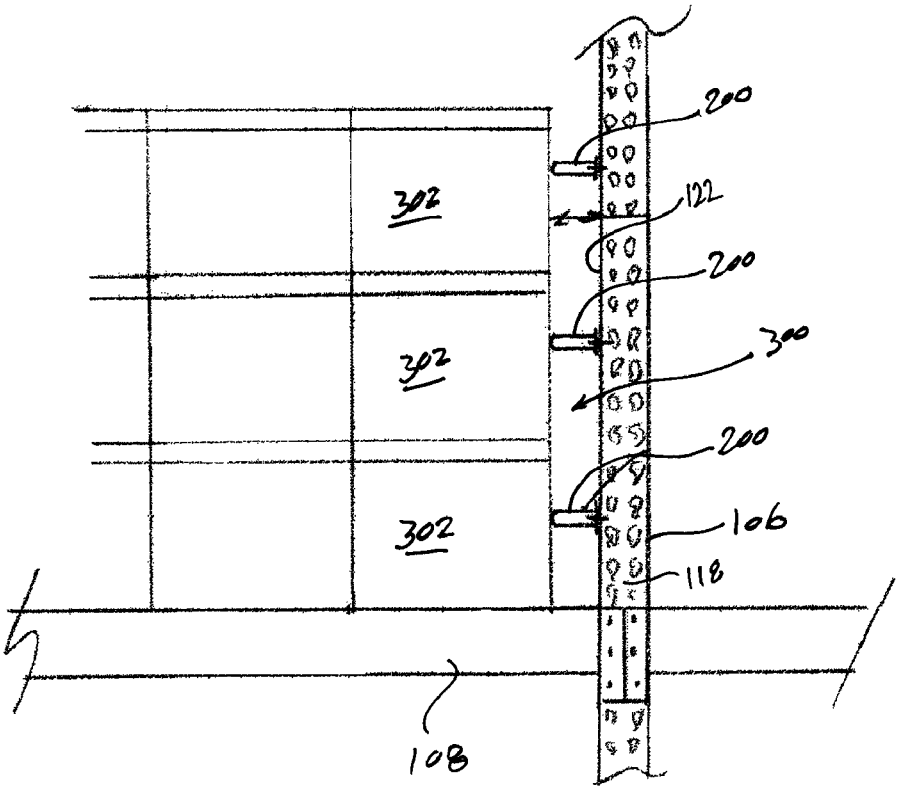

FIGS. 3*a* and 3*b* illustrate the flue spacer 200 of FIG. 2 attached to the vertical uprights 108 of a storage rack 102. Once attached, the spacer surface 202 is offset from the uprights 108, thus forming a vertical flue space 300 within the storage rack. The flue spacer surface 202 supports the items 302 in storage and keeps them from obstructing the flue space 300. The number of spacers 200 installed per shelf level of the storage rack can be selected based on the size of the items in storage. Fewer, taller items may require fewer flue spacers 200, and more, shorter items may require more flue spacers 200. Of course, it is not strictly necessary to provide flue spacers 200 for every level of stacked items on each shelf. Additionally, since the flue spacers 200 are installed within each shelf level, the spacer does not need to penetrate through the shelf levels and will thus not interfere with the placement of the shelves in the storage rack. This feature of the invention also aids with retrofitting pre-existing storage racks.

Figure 4:
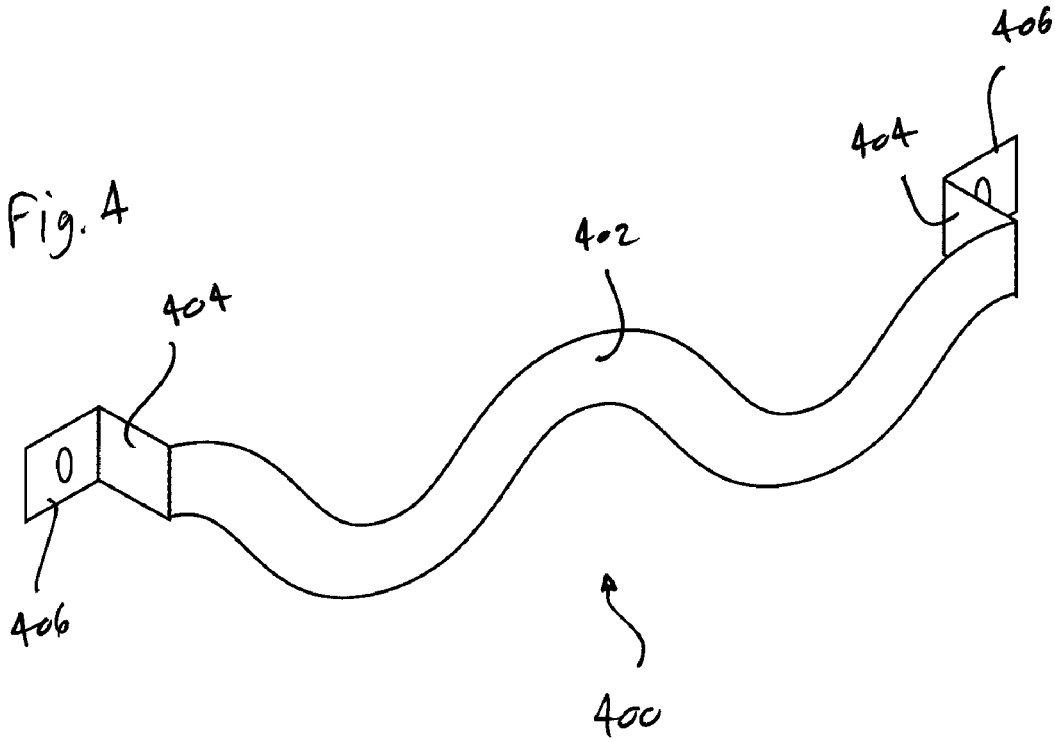
FIG. 4 illustrates an embodiment of a flue spacer having the spacer surface formed as a bent surface.
Figure 5B:
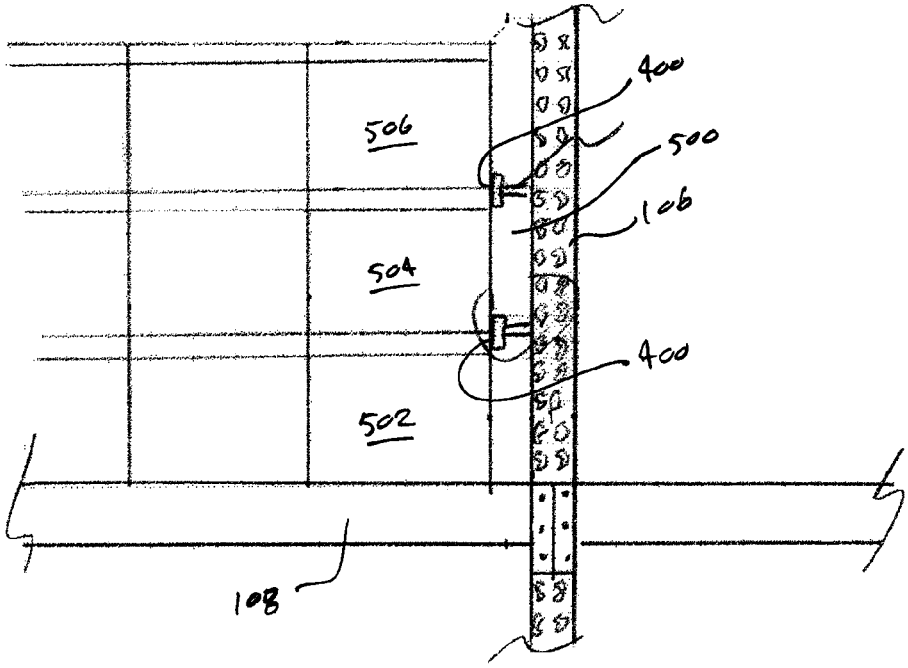
FIGS. 5A and 5B illustrate the embodiment of a flue spacer as shown in FIG. 4 installed in a storage rack.
Figure 5A:
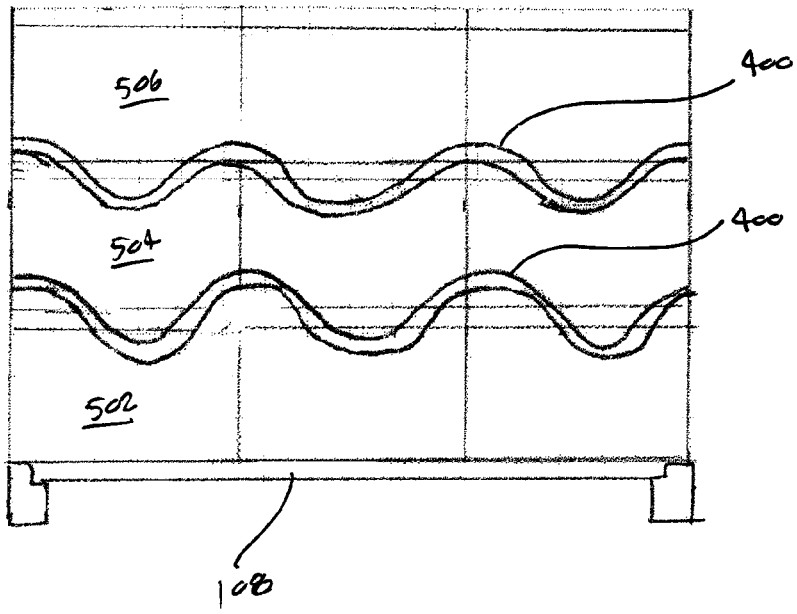

FIG. 4 illustrates another embodiment of a flue spacer 400 having the spacer surface 402 formed as bent or curved surface. Like the previous embodiment, the flue spacer 400 also has two legs 404, and an attachment element 406 associated with each leg 404. One benefit of this embodiment is that it can be used to support more layers of items in storage. For example, a single bent spacer surface 402 can support the tops of one row of boxes, and simultaneously support the bottoms of another row of boxes that are stacked on the other boxes. By supporting more layers, fewer spacers need to be implemented per layer of shelves in the storage rack. FIGS. 5A and 5B are end and front views of this embodiment of a flue spacer 400 installed in a storage rack. As shown, two flue spacers 400 are used to support three levels of boxes 502, 504, 506 to create a flue space 500.

Figure 6:
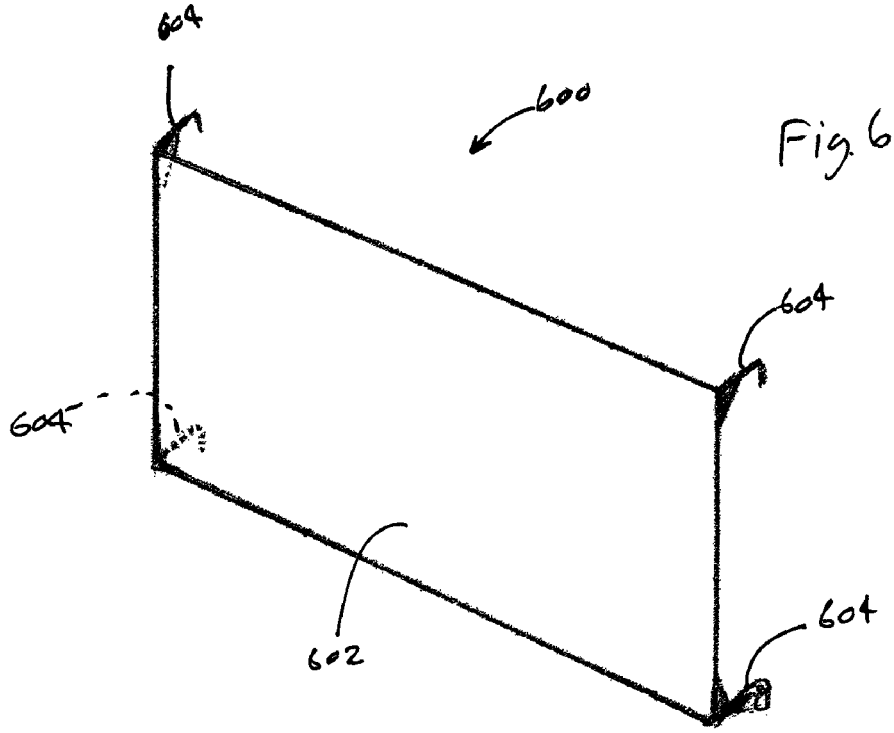
FIG. 6 illustrates an embodiment of a flue spacer having the spacer surface formed as a plate.
Figure 8A:
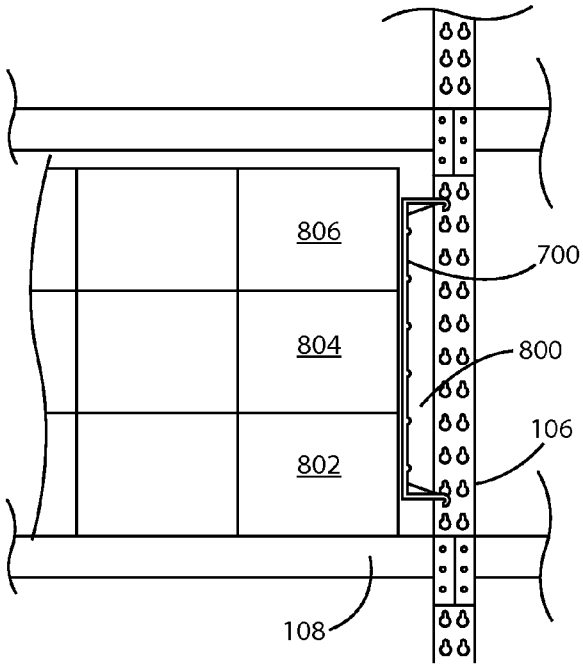
FIGS. 8A and 8B illustrate the embodiment of a flue spacer as shown in FIG. 7 installed in a storage rack.
Figure 8B:
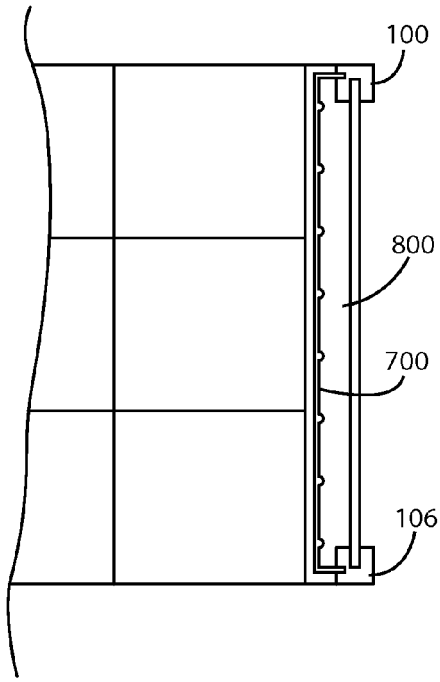
Figure 7:
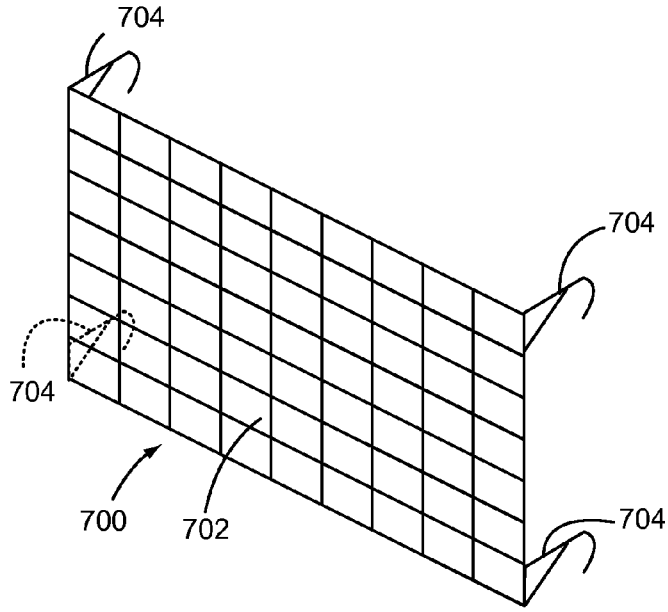
FIG. 7 illustrates an embodiment of a flue spacer having the spacer surface formed as a mesh.

FIG. 6 illustrates a flue spacer 600 with a spacer surface 602 formed as a plate, and FIG. 7 illustrates a flue spacer 700 with a spacer surface 702 formed as a mesh. In these two embodiments, the spacer has four legs 604 and 704, respectively (although three legs or more than four legs may be suitable). In the illustrated embodiments, the legs 604, 704 have attachment elements to mount them to the uprights 106, such as hooks that fit into corresponding openings 124 in the lateral faces 122 of the uprights 106. Of course, other attachment elements may be used instead, such as holes and fasteners, or tabs. The use of a plate or mesh as the spacer surface can provide more supporting surface area. For example, the embodiments of FIG. 7 is shown installed in a storage rack in FIGS. 8A and 8B (side and top views, respectively). Here, the flue spacer 700 supports three rows of boxes 802, 804, 806 to create a flue space 800. These embodiments might also be useful where multiple smaller or irregular items are being stored on the shelf.

Embodiments of the present invention may be assembled or attached to storage racks in any suitable manner. In a preferred embodiment, such as the embodiment of FIG. 2, the flue spacer 200 has simple holes 206 and/or slots through which screws or other fasteners pass to install the spacer 200 (see FIG. 2C). These holes 206 may be pre-drilled or made during the installation process. Most preferably, the attachment elements are adapted to engage the lateral surfaces 122 of the uprights, which simplifies their installation because an installer need not reach behind the rack to install them. This is particularly preferred with respect to the leg 204 that mounts to the rear upright 106, because access to the front face 118 of the rear upright is typically obstructed by an adjacent rack or wall.

The foregoing embodiment is preferred when the shelves are not already filled with boxes or other stored goods because, at that time, an installer can relatively easily attach both legs 204 to the storage rack uprights 106. This embodiment might, however, be somewhat more difficult to install when the shelves are already filled or partially-filled. As such, another embodiment of the invention replaces one of the holes 206 with a remotely-installable attachment device that can be firmly attached to the back upright 106 from a distance.

Figure 9A:
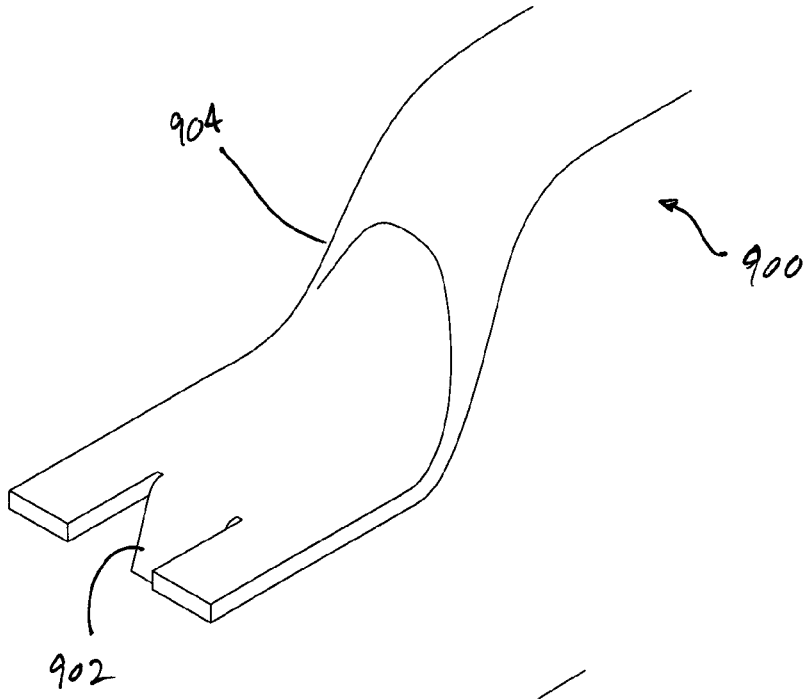
FIGS. 9A and 9B illustrate embodiments of remotely-installable attachment devices in the form of tabs and removable tabs, respectively.
Figure 9B:
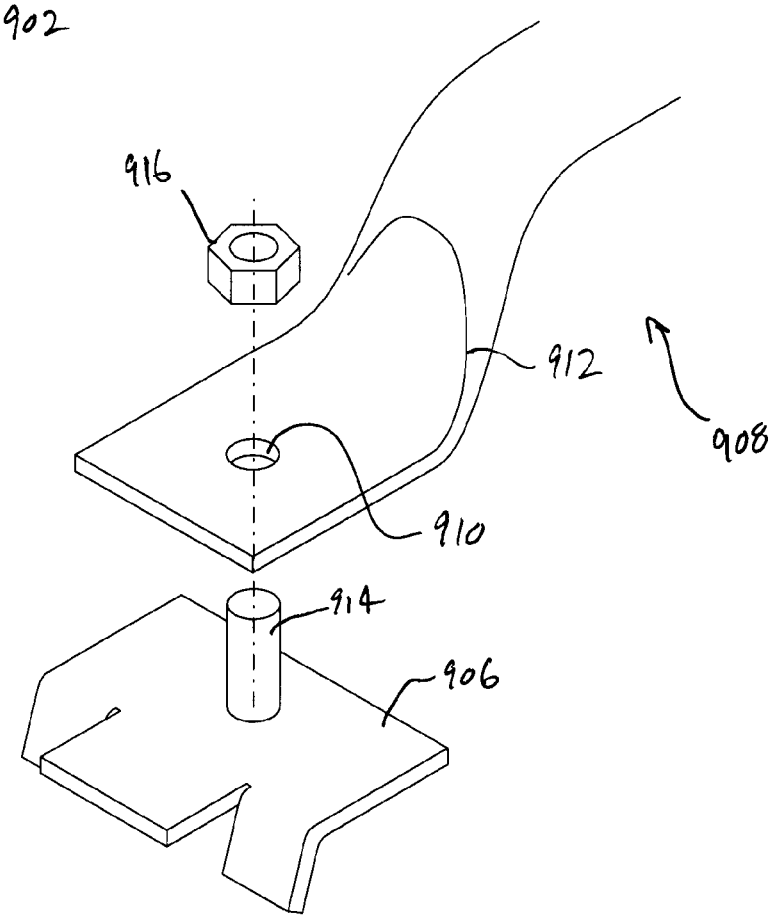

Examples of remotely-installable attachment devices are shown in FIGS. 6 and 7 in the form of hooks that drop into holes 124 on the lateral faces 122 of the uprights 106. Additional embodiments of remotely-installable attachment devices are shown in FIGS. 9A and 9B in the form of tabs. FIG. 9A illustrates a tab 902 formed into one spacer leg 904 of a flue spacer 900. FIG. 9B illustrates a tab 906 that can be attached to a hole 910 in a spacer leg 912 of another flue spacer 908. The tab 906 can be attached to the spacer leg by screws, rivets, a friction fit, welding, or any other suitable mechanism or process. In the shown embodiment, the tab 906 is removable, and is attached to the hole 910 by a threaded shaft 914 and suitable fastener 916, such as a hexagonal nut or a wingnut.

Any suitable tab shape may be used. In the embodiment of FIG. 9A, the tab 902 comprises a single rectangular protrusion that can fit into a standard-sized hole in an upright. In the embodiment of FIG. 9B, the tab 906 comprises a pair of rectangular protrusions that fit into adjacent holes in a upright.

Figure 10A:
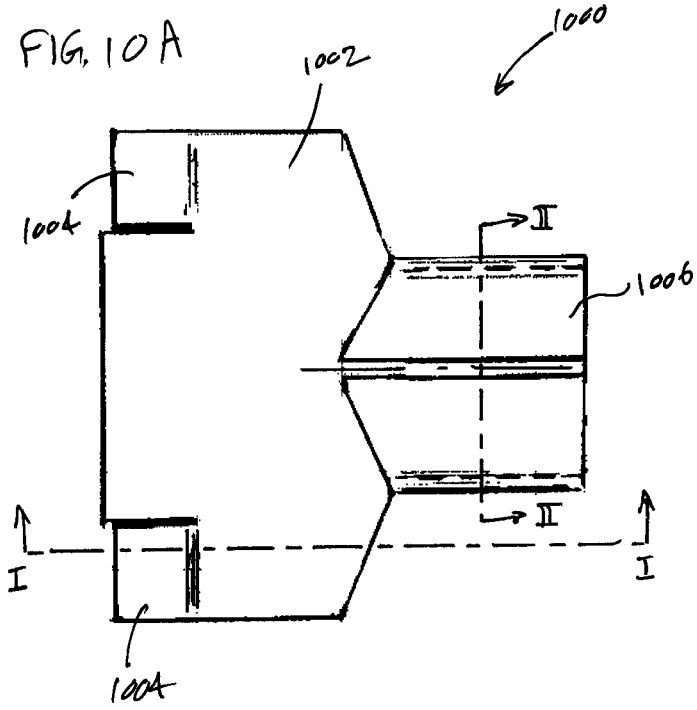
FIGS. 10A-10C illustrate three views of another embodiment of a remotely-installable attachment device in the form of a removable tab.
Figure 10B:
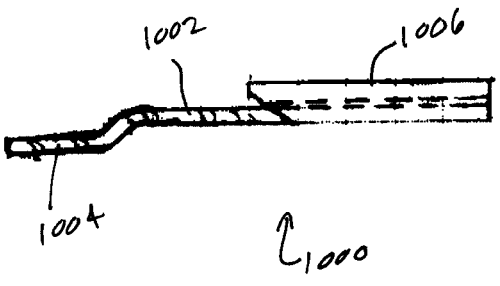
Figure 10C:
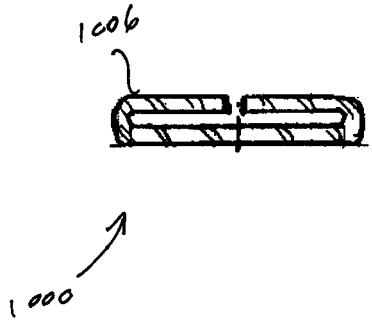

FIGS. 10A-10C illustrate another tab 1000 of the present invention, in which FIG. 10A is a plan view, FIG. 10B is a cutaway view as seen along line I-I of FIG. 10A, and FIG. 10C is a cutaway view as seen along line II-II of FIG. 10A. The tab 1000 comprises a base plate 1002 that is formed into a pair or tab protrusions 1004 at one end, and a collar 1006 at the other end. The tab protrusions are shaped to fit into the holes 124 on the lateral faces of the rack uprights 106, and may be modified depending on the particular shape and spacing of these holes 124. The collar 1006 is shaped to slip over the end of one flue spacer leg 204. Although it is not strictly necessary to firmly hold the collar 1006 onto the leg 204, if this is desired, a rib or protrusion (not shown), or other locking means, may be located within the collar 1006 to engage the leg 204 to hold it firmly in place. The collar 1006 may also be friction fit, fastened, welded, clamped, or otherwise attached to the end of the leg 204.

Additional and alternative shapes and sizes of tabs may be provided to fit into standard support openings, as will be appreciated by persons of ordinary skill in the art in view of the present disclosure. In one preferred embodiment, tabs 906 are provided with flue spacers as an adapter kit for installing the flue spacer in tight spaces or on shelves that already have boxes stored on them.

The tabs 900, 902 and 1000 attach the spacer 200 to the rack upright 106 by sliding into corresponding holes therein. These tabs are particularly useful for retrofitting storage racks that already have items stored on the shelves because an installer can simply reach the flue spacer back behind the stored goods and slide the tabs into holes in the uprights to secure the back of the flue spacer, all without having to remove the goods or climb into the shelf space. Once the rear tab is inserted, the installer can attach the front spacer leg using a fastener, hook, tab, or other attachment device.

Figure 11:
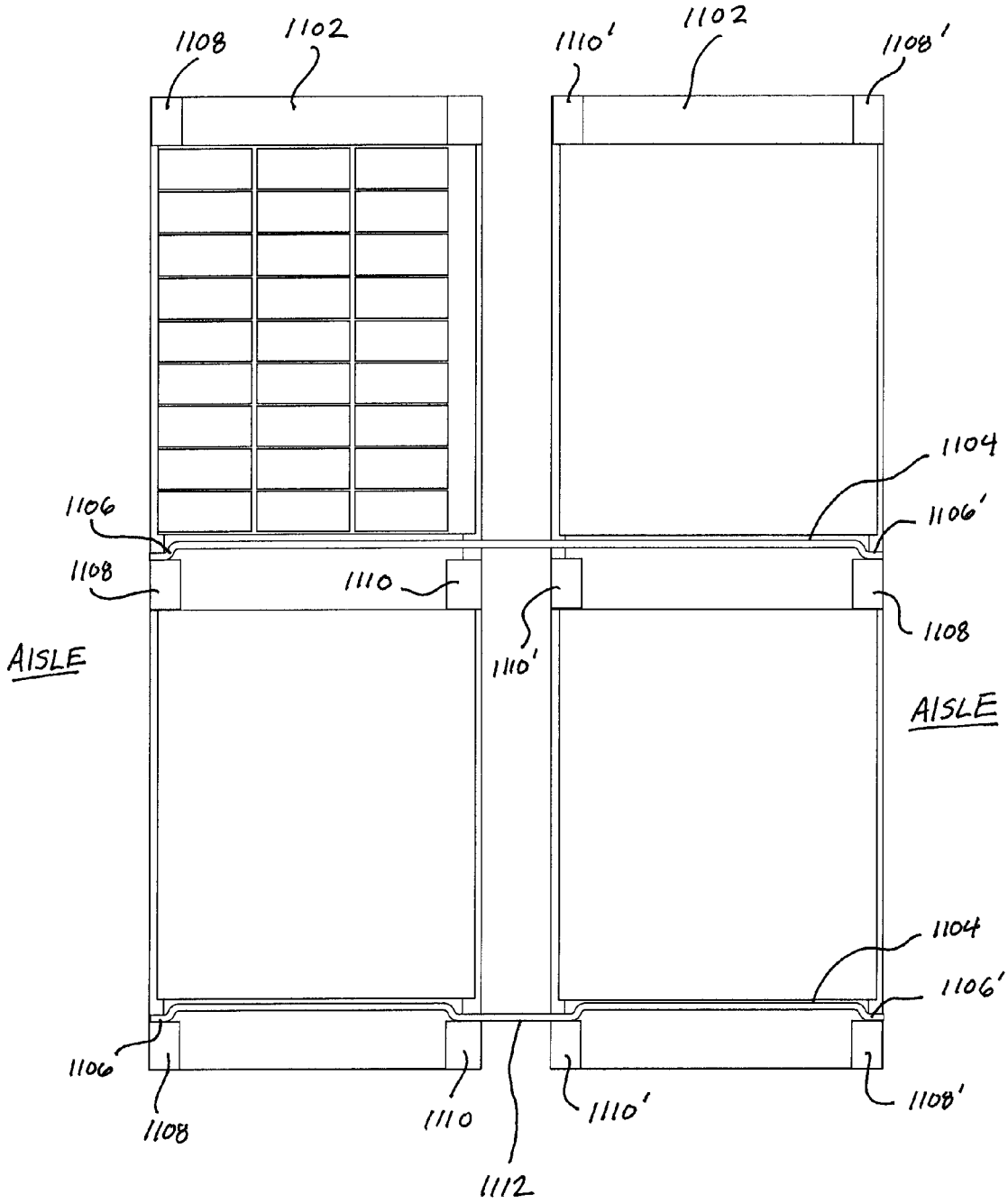
FIG. 11 illustrates a top view of alternative embodiment of the invention.

Referring now to FIG. 11, another embodiment of the invention is illustrated. In this embodiment, two storage racks 1102, 1102' are adjacent one another, and the flue spacer 1104 has been modified to extend transversely across both racks 1102, 1102'. Here, one flue spacer leg 1106 is attached to the aisle-side upright 1108 (i.e., the upright adjacent the aisle, as opposed to the upright adjacent the adjacent rack) of one storage rack 1102, and the other leg 1106' is attached to the aisle-side upright 1108' of the other storage rack 1102'. Using this construction it is not necessary to remotely install the back leg of each flue spacer, potentially easing installation when boxes or goods are already on the racks, and fewer parts are required to fully equip the facility with flue spacers. Other than being adapted to extend across two racks, the flue spacer 1104 is the same as described previously herein. If desired, the spacer 1104 may also include a brace (which may be a separate part, an attached part, or simply and curved central portion of the flue spacer 1112, as shown in the lower embodiment) that abuts one or both of the two center uprights 1110, 1110' to help prevent the longer flue spacer 1104 from bending should the boxes or other goods press against it.

It should be understood that the foregoing embodiments are exemplary only, and other embodiments will be apparent to those of ordinary skill in the art in light of the teachings provided herein. For example, any type of fastening mechanism may be used to install the spacers, and the spacers can take any suitable shape. Spacers may be installed in any suitable pattern to obtain the desired flue space volume, and may be made larger or smaller, or attached with shims, to provide smaller or larger flue spaces, if necessary or desired. Also, the spacers may be installed by attaching them to the shelves or horizontal or angled rack elements, rather than the uprights. The claimed invention is limited only by the following claims.

What is claimed is:

1. A shelving system comprising:

a plurality of vertically-extending uprights arranged as a first pair of uprights spaced in a transverse direction and a second pair of uprights spaced in the transverse direction, the second pair of uprights being spaced from the first pair of uprights in a longitudinal direction that is perpendicular to the transverse direction to form a generally rectangular horizontal shelving space between the uprights;

a plurality of crossbars extending in the longitudinal direction and joining the first pair of uprights with the second pair of uprights;

shelves suspended on said crossbars; and a flue spacer provided separately from said crossbars and said shelves, the flue spacer comprising a spacer surface extending in the transverse direction and first and second legs extending from said spacer surface and being adapted to attach said spacer surface to said first pair of uprights such that said spacer surface is offset in the longitudinal direction from the first pair of uprights to form a vertical flue space within the storage rack;

wherein at least one of said first and second legs is adapted to attach to a lateral surface of at least one of said first pair of uprights, and wherein said flue spacer is selectively movable along the first pair of uprights among a plurality of vertically-spaced mounting locations located between two adjacent vertically-spaced shelves.

2. The shelving system of claim 1, wherein said spacer surface comprises a tubular rod, and said first and second legs comprise bent and flattened end portions of said tubular rod.

3. The shelving system of claim 1, wherein said spacer surface comprises a generally linear surface.

4. The shelving system of claim 3, wherein said generally linear surface has a circular profile.

5. The shelving system of claim 1, wherein said first and second legs each comprise an attachment element to mount said legs to said uprights.

6. The shelving system of claim 5, wherein said attachment element is selected from the group consisting of a removable tab, and a hole for a fastener.

7. The shelving system of claim 6, wherein said attachment element of said first leg is different from said attachment element of said second leg.

8. The shelving system of claim 7, wherein said attachment element of said first leg is a tab, and said attachment element of said second leg is a hole for a fastener, said tab being adapted to be remotely installed in a corresponding upright.

9. The shelving system of claim 1, further comprising third and fourth legs extending from said spacer surface and being adapted to attach the spacer surface to said at least two uprights.

* * * * *